United States Patent [19]

Wootten

[11] 3,953,634

[45] Apr. 27, 1976

[54] SEAM STRUCTURE

[76] Inventor: William A. Wootten, 425 Via Corta, Malaga Cove Plaza, Palos Verdes Estates, Calif. 90274

[22] Filed: Aug. 22, 1973

[21] Appl. No.: 390,680

[52] U.S. Cl. ..... 428/133; 93/1.1; 229/48 R

[51] Int. Cl.[2] ..... B31F 5/02; B32B 3/10

[58] Field of Search ..... 161/109, 111, 112, 114, 161/115; 229/39 R, 40, 48 R; 156/293, 252, 257, 268, 157, 253; 93/1.1; 242/58.1; 264/154, 156; 428/53, 131, 132, 133, 134, 135, 136, 137, 138, 139, 140

[56] References Cited

UNITED STATES PATENTS

| | | | |
|---|---|---|---|
| 1,850,071 | 3/1932 | Boyer | 156/293 X |
| 2,178,984 | 11/1939 | Zimmerman | 156/293 X |
| 2,656,969 | 10/1953 | Kvasnok et al. | 229/489 R X |
| 2,814,159 | 11/1957 | Green | 161/13 X |
| 3,202,340 | 8/1965 | Johnston | 229/39 |
| 3,249,284 | 5/1966 | Wood | 229/48 R X |
| 3,497,924 | 3/1970 | Lock | 229/39 X |
| 3,508,699 | 4/1970 | Graser | 229/40 |
| 3,517,589 | 6/1970 | Herd et al. | 161/111 X |
| 3,650,881 | 3/1972 | Giannone, Sr. | 161/111 |
| 3,741,079 | 6/1973 | Bossons et al. | 93/1.1 |
| 3,749,636 | 7/1973 | Tranquillitsky | 161/37 |
| 3,779,448 | 12/1973 | Wootten | 229/48 R |
| 3,793,791 | 2/1974 | Wootten | 229/49 |
| 3,793,928 | 2/1974 | Wootten | 93/1.1 |
| 3,846,218 | 11/1974 | Wootten | 428/132 |

FOREIGN PATENTS OR APPLICATIONS

| | | | |
|---|---|---|---|
| 67,716 | 9/1948 | Denmark | 229/48 R |
| 1,199,123 | 7/1970 | United Kingdom | 270/53 |

*Primary Examiner*—George F. Lesmes
*Assistant Examiner*—Henry F. Epstein
*Attorney, Agent, or Firm*—Elliott I. Pollock

[57] ABSTRACT

A pair of paper board panels are joined together by means of a seam structure comprising interlocking portions of the two panels. The first panel has a plurality of spaced partial perforations which define the plurality of flat first tabs each of which is displaced away from one side of the first panel about a hinge line in the first panel. The second panel is provided with a plurality of second tabs along one edge thereof each of which has a relatively narrow neck flaring outwardly into a wider tip portion. The second tabs are inserted through the partial perforations with the free ends of the second tabs being disposed adjacent the hinge lines of the first tabs, and with portions of the second tabs extending beyond the edges of their associated partial perforations to overlie the first panel on the side thereof adjacent the first tabs. The first tabs are positioned in closely adjacent parallel planar relationship to the second tabs, and the facing surfaces of the first and second tabs respectively are adhesively secured to one another.

6 Claims, 4 Drawing Figures

SEAM STRUCTURE

BACKGROUND OF THE INVENTION

Various forms of containers, fabricated of paper board or other similarly flexible material, have been suggested heretofore. Such containers, boxes, or packages have, in accordance with one approach taken by the prior art, been fabricated by die cutting a roll of previously printed material, and by thereafter bending various portions of the die-cut configuration relative to one another to form the bottom, sides, and top of a box-like structure, the edges of which are secured to one another by glued seams.

This approach to box manufacture has a number of disadvantages. Since the box or container is formed, in its entirety, by bending portions of a unitary die-cut configuration relative to one another, all portions of the box are fabricated of the same basis weight of paper stock, and it is not possible, in this manufacturing technique, to use different basis weights of paper to form side and end flaps of the box respectively. In addition, since all portions of the box are formed by bending unitary portions of a die-cut panel relative to one another, the actual formation of the box tends to become comparatively time consuming, thereby increasing the cost of the box or container relative to its contents.

In an effort to obviate some of the foregoing difficulties, it has been suggested that packages be fabricated by passing roll stock through a printing unit operative to produce the desired logo, trademarks, etc., on said stock, with the material so printed then being slit into widths of appropriate dimension, and thereafter cut to desired lengths to form the individual sides, and bottoms, of a container structure of predetermined size. Such roll stock material can be driven through an automatic box forming machine by a sprocket mechanism which engages indexing holes formed along one edge of each strip; and the said indexing holes also provide a mechanism for effectively measuring the length of strip material being transported through the machine, to permit the strip to be cut into desired lengths automatically.

When an arrangement of this type is employed, it becomes possible to use two or more paper weights in the same box, e.g., one, comparatively heavy, paper weight can be employed to form the wide or main panel of a box structure whereas a lesser weight paper can be employed to form comparatively narrow end panels, as well as the bottom and top of the box structure. In addition, the dimensions of the box sides and ends can be readily varied at will to permit the fabrication of containers of varying dimension; and much greater flexibility is achieved in respect to the printing of the various box panels since the printing on selected portions of the box can be changed as desired without requiring any change in the printed information appearing on other portions of the box.

In order to seam the various panels together, in an automatic box-forming machine of the type discussed above, it has been suggested heretofore that the edges of the panels be somehow interlocked through the agency of their respective indexing holes or edge perforations. The types of seam arrangements suggested heretofore have, however, tended to produce a comparatively weak seam since portions of each edge of the panels being joined have been removed to form their respective indexing holes. In addition, seams formed by such interengagement of indexing holes tend to exhibit gaps between the interlocked portions of adjacent panels, whereby the seam is not "insect proof". In order to avoid these disadvantages, it has therefore been suggested that the seams be encapsulated in plastic material, or that the edges of the panels be overlapped sufficiently to permit the formation of a continuous new seam therebetween; but these alternative approaches, adopted in an effort to increase the strength and insect-proofness of the seam, represent comparatively expensive undertakings which, in addition, require the provision of additional equipment, thereby tending to increase the cost of the box.

The present invention, recognizing these disadvantages of the prior art, is concerned with an improved seam structure characterized by novel arrays of perforations in the cooperating edges of a pair of panels, which perforations are capable of being used for the transport of panels through an automatic box-forming machine, and which perforations are so fabricated that the adjacent edges of two panels may be readily interlocked with one another to form a seam structure which is far stronger than has been possible heretofore, and which is completely insect-proof.

SUMMARY OF THE INVENTION

In accordance with the present invention, one of the two panels which are to be joined together is provided with a row of partial perforations therein each of which defines a first tab which is displaced away from one side of said first panel about a hinge line comprising the uncut portion of its associated partial perforation. The other panel, to be joined to said one panel, is provided, along a boundary edge thereof, with a row of round perforations which open into said boundary edge, thereby to form, between said round perforations, a plurality of second tabs each of which has a comparatively narrow neck flaring outwardly into a wider tip portion.

The two panels, so perforated, are assembled by positioning the second tabs over the partial perforations in the first panel, on the side of said first panel opposite to said first tabs. A force is then applied to each second tab to cause said second tab to be distorted so as to pass through said partial perforation towards said first tab; and when said second tabs have passed through said partial perforations, their inherent flexibility causes them to regain their original shape. As a result, the free ends of said second tabs are disposed closely adjacent the hinge lines of said first tabs, and portions of each second tab extend beyond the boundary edges of its associated partial perforations so as to overlie portions of said first panel on the side thereof adjacent said first tab. The first tabs are then bent back toward their associated partial perforations e.g. by a rolling operation, and are adhesively secured to the second tabs respectively to form a seam structure between said panels. Since the partial perforations, and the first tabs formed thereby, do not remove any fiber from the first panel, the resultant seam is much stronger than has been the case in the prior art. In addition, since the second tabs overlie the edges of and fill the partial perforations in the first panel, and since the first tabs are, in addition, returned toward their original position and adhesively secured to the second tabs, the resultant structure is impervious and insect proof.

DESCRIPTION OF THE PREFERRED EMBODIMENTS

Figure 1:
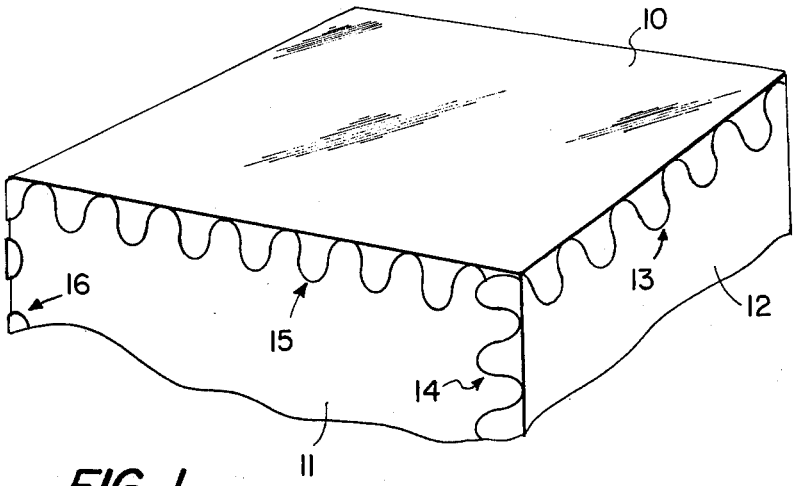
FIG. 1 diagrammatically represents a container fabricated by seaming panels together, in accordance with the present invention.

FIG. 1 illustrates a portion of a container constructed in accordance with the present invention. It comprises a top panel 10 and side panels such as 11 and 12 associated with other such side panels, and with a bottom panel, all assembled by means of seams such as 13, 14, 15 and 16 to form a completely enclosed box. While panels 11 and 12 are depicted in FIG. 1 as having substantially the same width, it will be appreciated that one of said panels may be considerably narrower in width than the other. The several panels may have different basis weights respectively, as described previously, and some or all of the panels may be preprinted with any desired information prior to the interlocking of said panels at the aforementioned seam structures. If desired, the top and bottom panels (such as 10) may each constitute a conventional glued flat assembly, with the seam of the present invention being used only on the vertical corners of the box (as at 14 and 16) to still permit the employment of various basis weights on the side and end panels of the box.

Figure 2:
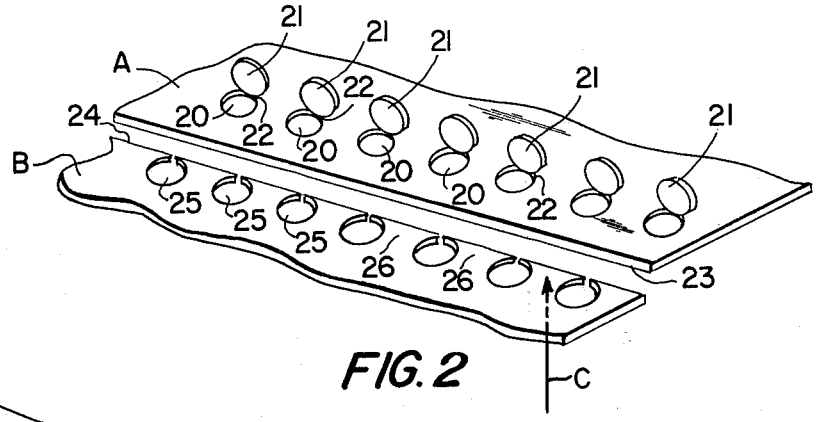
FIG. 2 depicts the cooperating edges of a pair of panels, disposed in space relation to one another, preparatory to formation of the seam of the present invention.

FIG. 2 depicts portions of two box panels, designated A and B respectively, each perforated to permit the panels to be transported through an automatic box-forming machine as described earlier, and each perforated in a particular configuration to permit the panels to be interlocked with one another to form the novel seam structure of the present invention, in the assembly of a box of the type described in reference to FIG. 1. Panel A is provided with a row of partial perforations 20 each of which is round in configuration (although other shapes could be employed) and each of which defines an integral flap 21 bent about a hinge line 22 comprising an uncut portion of each partial perforation 20 in panel A. The several flaps 21 are, as illustrated in FIG. 2, bent in an upward direction about their respective hinge line 22, i.e., said flaps 21 are bent away from that side of panel A which is opposite to panel B.

In FIG. 2, the several partial perforations 20, and their associated flaps 21, are disposed along a straight line adjacent to but spaced inwardly of a boundary edge 23 of said panel A; and this disposition of partial perforations 20 is employed to form edge seams of the type depicted in FIG. 1. The said partial perforations 20 and their associated flaps may, however, be located at an interior portion of panel A, relatively widely spaced from boundary edge 23, when it is desired to form a divider structure within the container.

Panel B is provided, along its boundary edge 24, with a plurality of further perforations 25 each of which is round, and each of which intersects and opens into the boundary edge 24 of panel B. By reason of this configuration, those portions of panel B which lie between the several perforations 25 form a plurality of tabs 26 each of which has a comparatively narrow neck which flares outwardly into a wider tip portion. The width of the comparatively narrow neck in each tab 26, in a direction parallel to boundary edge 24, is determined by the spacing between the several round perforations 25; and said neck width is chosen to be substantially equal to the diameter of each of the round partial perforations 20 in panel A.

In assembling the seam of the present invention, the panel B is placed below panel A, i.e., it is placed on the side of panel A opposite to deflected tabs 21 and the panels A and B are so positioned relative to one another that each tab 26 overlies an associated partial perforation 20 with the free end of each tab 26 being disposed substantially colinear to the hinge line 22 in said associated partial perforation. An "upward" force is then applied to the center of each tab 26, as depicted generally by arrow C, to cause the edges of each tab 26 to be deflected against the edges of its associated partial perforation 20 in panel A, whereby said tab 26 is distorted and forced through its associated partial perforation. When it has been deflected completely through its partial perforation 20, the inherent flexibility of each tab 26 causes it to regain its original shape and to become interlocked with a partial perforation 20.

Figure 3:
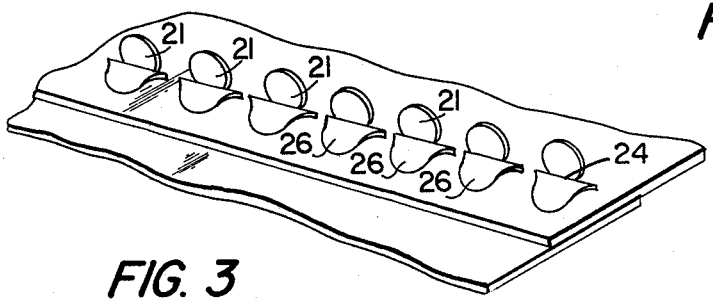
FIG. 3 shows the elements of FIG. 2 in assembled relation to one another at an intermediate step in the formation of the seam of the present invention.

FIG. 3 illustrates the configuration of the seam structure after the several tabs 26 have been forced through the partial perforations 20 as described above. It will be noted that the free end of each tab 26 is disposed closely adjacent and parallel to the hinge line 22 in its associated partial perforation 20. Moreover, due to the fact that each tab 26 exhibits a relatively wide free end, dimensioned to be greater than the diameter of its associated perforaton 20, each tab 26, adjacent its free end, extends beyond the boundary edges of its associated partial perforation 20 and overlies the upper surface of panel A.

The several tabs 21 are coated with an adhesive on the faces thereof closest to tab 26; and, following the assembly shown in FIG. 3, the adhesively coated tabs 21 are rolled downwardly toward their associated partial perforation 20 so as to engage and be adhesively secured to the intervening surface of a tab 26.

Figure 4:
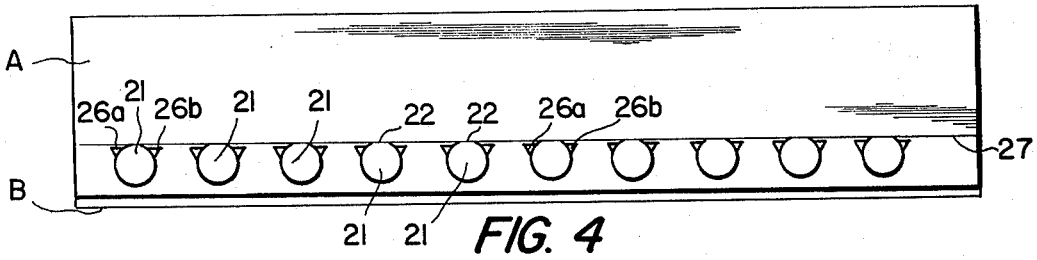
FIG. 4 shows the completed seam of the present invention.

The resultant seam is shown in FIG. 4. Portions of each tab 26 extend beyond covering tab 21, as designated at **26*a* and 26*b*. The assembled panels A and B can be bent about a line 27, substantially colinear with hinge lines 22 and the aligned edges of tab portions 26*a*, 26*b*, to displace panels A and B at an angle to one another, e.g., at right angles, to form the corner of a box structure. When the panels are so bent relative to one another about line 27, the seam configuration shown in FIG. 4 can be disposed on the interior of the box, in which event the exterior of the seam structure has the configuration shown in FIG. 1.**

Having thus described my invention I claim:

1. A seam structure comprising a first panel having a plurality of spaced, rounded partial perforations therein bounded by the material of said first panel and defining a plurality of flat first tabs each of which is displaced away from one side of said first panel about a hinge line comprising the uncut portion of its associated partial perforation, a second panel positioned on the other side of said first panel and having a row of round perforations along a boundary edge thereof and opening into said boundary edge respectively and defining a plurality of spaced flat second tabs between said round perforations respectively, each of said second tabs having a comparatively narrow neck with arcuate sides flaring outwardly into a wider tip portion having an outer free end, the minimum width of each of said arcuatesided necks being substantially equal in dimension to the diameter of each of the partial perforations in said first panel, the necks of said second tabs extending from said second panel from a position on the other side of said first panel through said rounded partial perforations respectively to a position adjacent said one side of said first panel, the outwardly flaring neck and tip portions of each of said flat second tabs being disposed in closely adjacent surface facing relationship to one of said flat first tabs in a plane generally parallel to the plane defined by the edge of the associated partial perforation and at a position adjacent said one side of said first panel, the wider tip portion of each of said second tabs being shaped and dimensioned to extend beyond the boundary edge of the partial perforation through which the neck of said second tab extends so as to overlie said one side of said first panel, the free ends of said second tabs comprising portions of said boundary edge of said second panel and being disposed closely adjacent to the hinge lines of said first tabs respectively on said one side of said first panel, and the facing surfaces of said flat first and second tabs being attached to one another by a layer of adhesive therebetween to hold said tabs in generally parallel planar relationship to one another.

2. The structure of claim 1 wherein said plurality of partial perforations are disposed along a substantially straight line.

3. The structure of claim 2 wherein said straight line is positioned closely adjacent and substantially parallel to a boundary edge of said first panel.

4. The structure of claim 1 wherein said first and second panels are paperboard panels.

5. The structure of claim 1 wherein said first and second panels are disposed at an angle to one another.

6. The seam structure of claim 1 wherein the free end of each of said second tabs is linear and is disposed parallel to the hinge line of one of said first tabs, each of said linear free ends being longer than the hinge line adjacent thereto and being so positioned relative to said hinge line that the free end of said second tab overlies said one side of said first panel adjacent both ends of said hinge line.

* * * * *